US010996019B2

(12) United States Patent
Liu

(10) Patent No.: US 10,996,019 B2
(45) Date of Patent: May 4, 2021

(54) SUPPORT DEVICE FOR A CROSSBOW

(71) Applicant: Chi-Chang Liu, Taichung (TW)

(72) Inventor: Chi-Chang Liu, Taichung (TW)

(73) Assignee: POE LANG ENTERPRISE CO., LTD., Taichung (TW)

( * ) Notice: Subject to any disclaimer, the term of this patent is extended or adjusted under 35 U.S.C. 154(b) by 0 days.

(21) Appl. No.: 16/935,201

(22) Filed: Jul. 22, 2020

(65) Prior Publication Data

US 2021/0048271 A1 Feb. 18, 2021

Related U.S. Application Data

(62) Division of application No. 16/541,178, filed on Aug. 15, 2019.

(51) Int. Cl.

| | |
|---|---|
| ***F16M 13/00*** | (2006.01) |
| ***F41B 5/14*** | (2006.01) |
| *F41B 5/12* | (2006.01) |

(52) U.S. Cl.

CPC ..... *F41B 5/1453* (2013.01); *F41B 5/12* (2013.01)

(58) Field of Classification Search

CPC ..... F41B 5/1461; F41B 5/1453; F41B 5/14; F41B 5/066; A01M 31/00

See application file for complete search history.

(56) References Cited

U.S. PATENT DOCUMENTS

| | | | | |
|---|---|---|---|---|
| 2014/0361143 | A1* | 12/2014 | May | F41B 5/1461 248/688 |
| 2016/0054090 | A1* | 2/2016 | Nettleton | F41B 5/1453 124/86 |
| 2019/0049210 | A1* | 2/2019 | Bunch | F41B 5/1453 |

* cited by examiner

*Primary Examiner* — Amy J. Sterling

(57) ABSTRACT

A crossbow includes a body, a grip portion, an aim device rack, a stock connected to the rear end of the body, and two support devices connected to two sides of the front end of the body. Each support device includes an inclined face including a low end is located corresponding to the aim device rack, and a high end located corresponding to the grip portion. A link is connected between the two support devices. A base is connected to the link. Two support legs angularly extend from the base. The crossbow can be operated in a prone position. The crossbow can be positioned between a first position where the two high ends contact the ground, and a second position where both of the high end and the low end of each of the two inclined faces contact the ground. The crossbow does not fall in first and second positions.

2 Claims, 12 Drawing Sheets

SUPPORT DEVICE FOR A CROSSBOW

This patent application is a divisional patent application of the patent application with application Ser. No. 16/541,178.

BACKGROUND OF THE INVENTION

1. Fields of the Invention

2. Descriptions of Related Art

The conventional crossbows generally include a stock, a grip and a bow, the users have to pull the string and position the string, and the arrow is then engaged with the string. The users holds the grip by one hand, and support the body of the crossbow by the other hand. By pulling the trigger, the string is released, and the arrow shoots out.

However, the crossbow is heavy due to more parts are involved, and the weight of the crossbow makes the users feel uncomfortable when aiming a target. On the other hand, when not in use, the conventional crossbows do not have any stand-up design for the users to temporally put the crossbows aside.

The present invention intends to provide a support device that allows the crossbow to stand upright stably.

SUMMARY OF THE INVENTION

The present invention relates to a support device for a crossbow, wherein the crossbow comprises a crossbow having a body, a grip portion on the underside of the body, an aim device rack on the top side of the body, and a stock connected to the rear end of the body. Two support devices are respectively connected to two sides of the front end of the body. Each support device comprises an inclined face which includes a low end located corresponding to the aim device rack, and a high end located corresponding to the grip portion.

A link is connected between the two support devices, and includes a lock hole defined centrally therethrough. Two support legs angularly extend from a base which is locked to the lock hole of the link. The crossbow can be operated in a prone position by the two support legs.

The crossbow is positioned between a first position and a second position. The two respective high ends of the two inclined faces contact the ground when the crossbow is positioned at the first position, and an angle is formed between the inclined face of each support device and the ground. The first position defines a first weight center of the crossbow. When the crossbow is positioned at the second position, both of the high end and the low end of each of the two inclined faces contact the ground. The second position defines a second weight center of the crossbow. When the body shifts from the first position to the second position, the first weight center transfers to the second weight center so that the grip portion and the aim device rack reach a weight balance.

The advantages of the present invention are that the body does not fall due to the different weights of the grip portion and the aim device rack when the body is positioned at the second position where both of the two inclined faces contact the ground so that the first weight center is changes to the second weight center, and the body is stable and does not fall.

The co-application of the present invention has granted in Taiwan and issued as Taiwanese Patent No. 1695154 which was published on Jun. 1, 2020.

The present invention will become more apparent from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
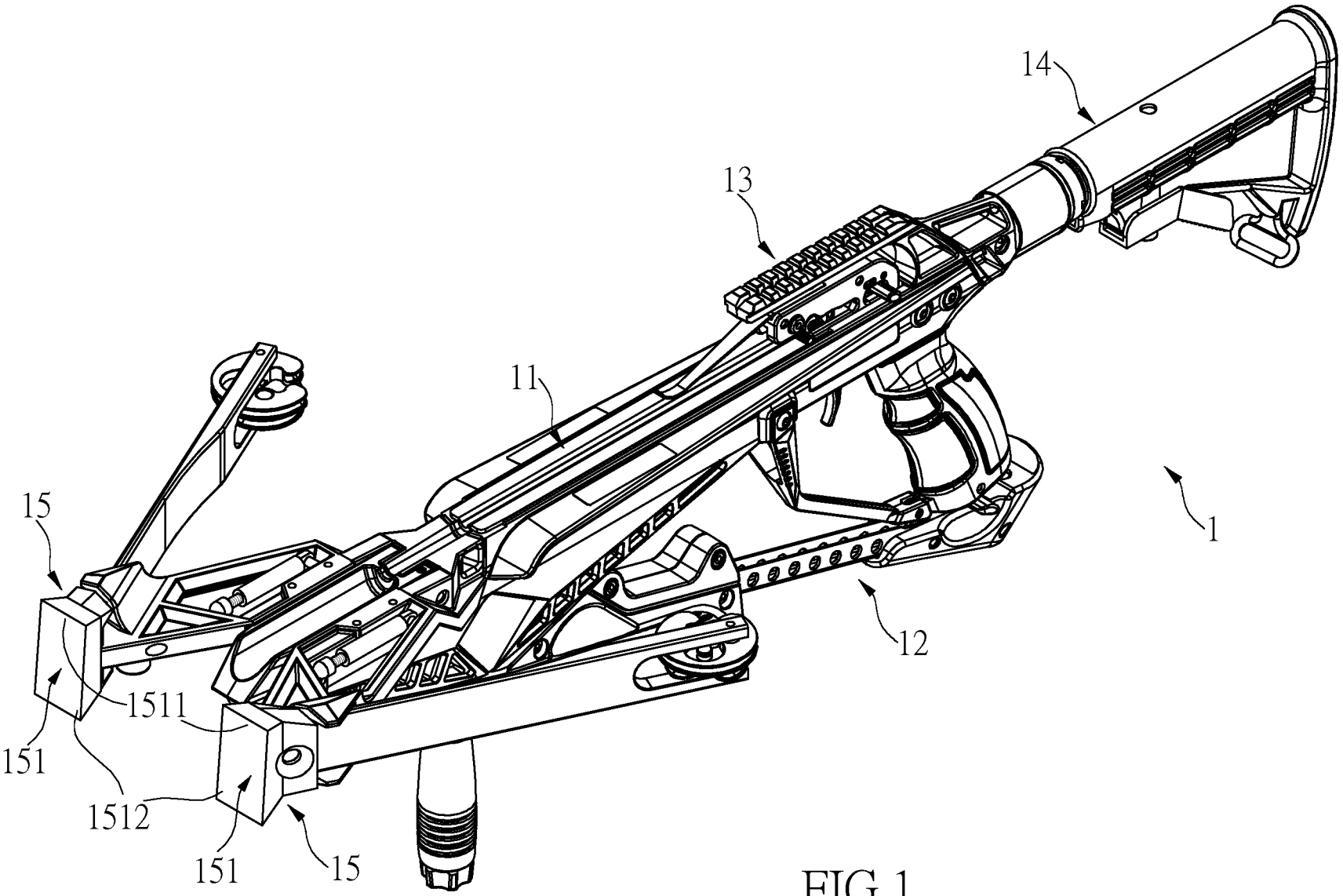
FIG. 1 is a perspective view to show the crossbow with the support device of the present invention.
Figure 2:
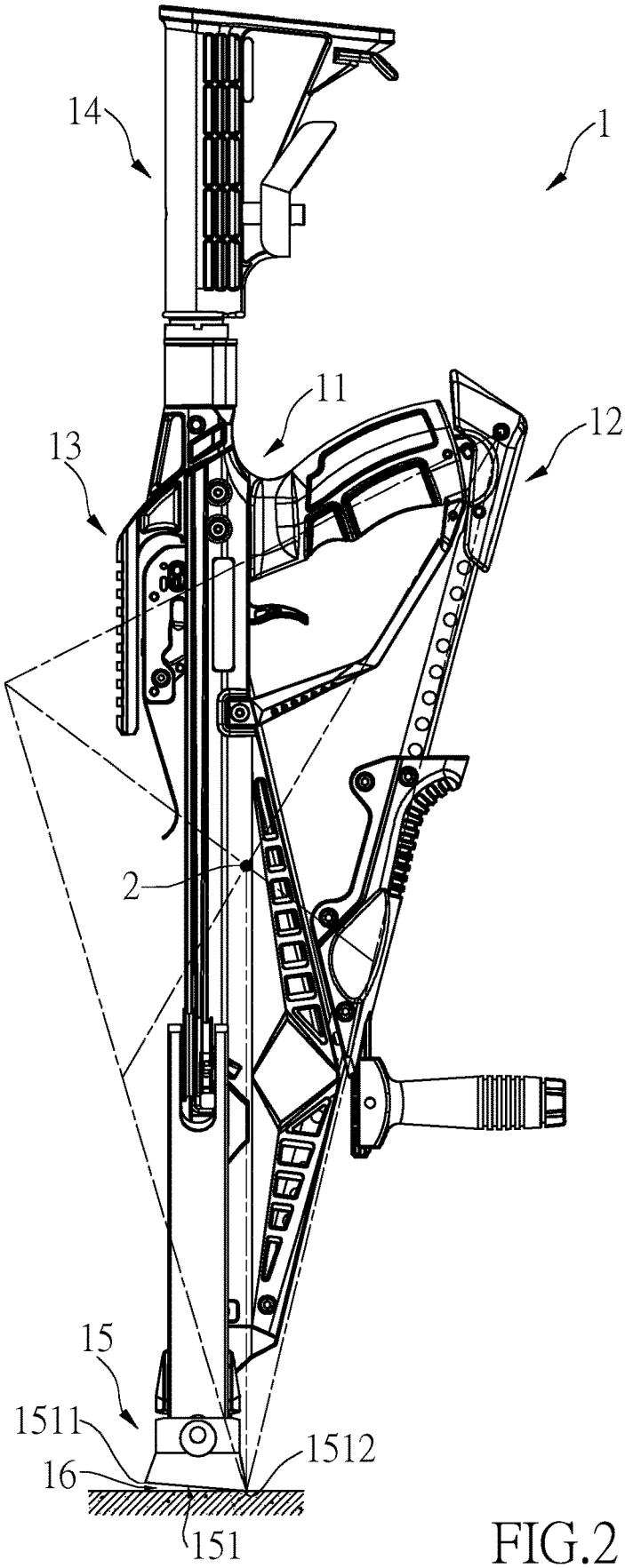
FIG. 2 shows that the body of the crossbow is positioned at the first position.
Figure 3:
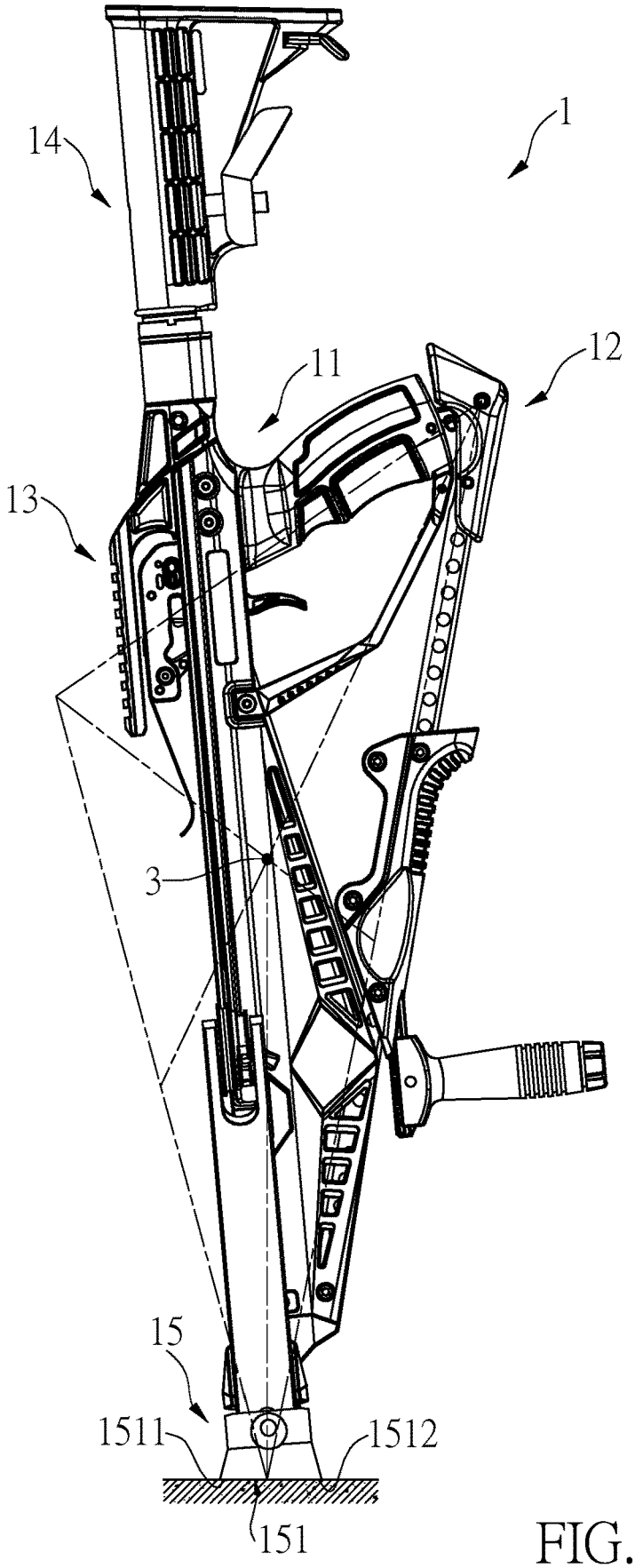
FIG. 3 shows that the body of the crossbow is positioned at the second position.
Figure 4:
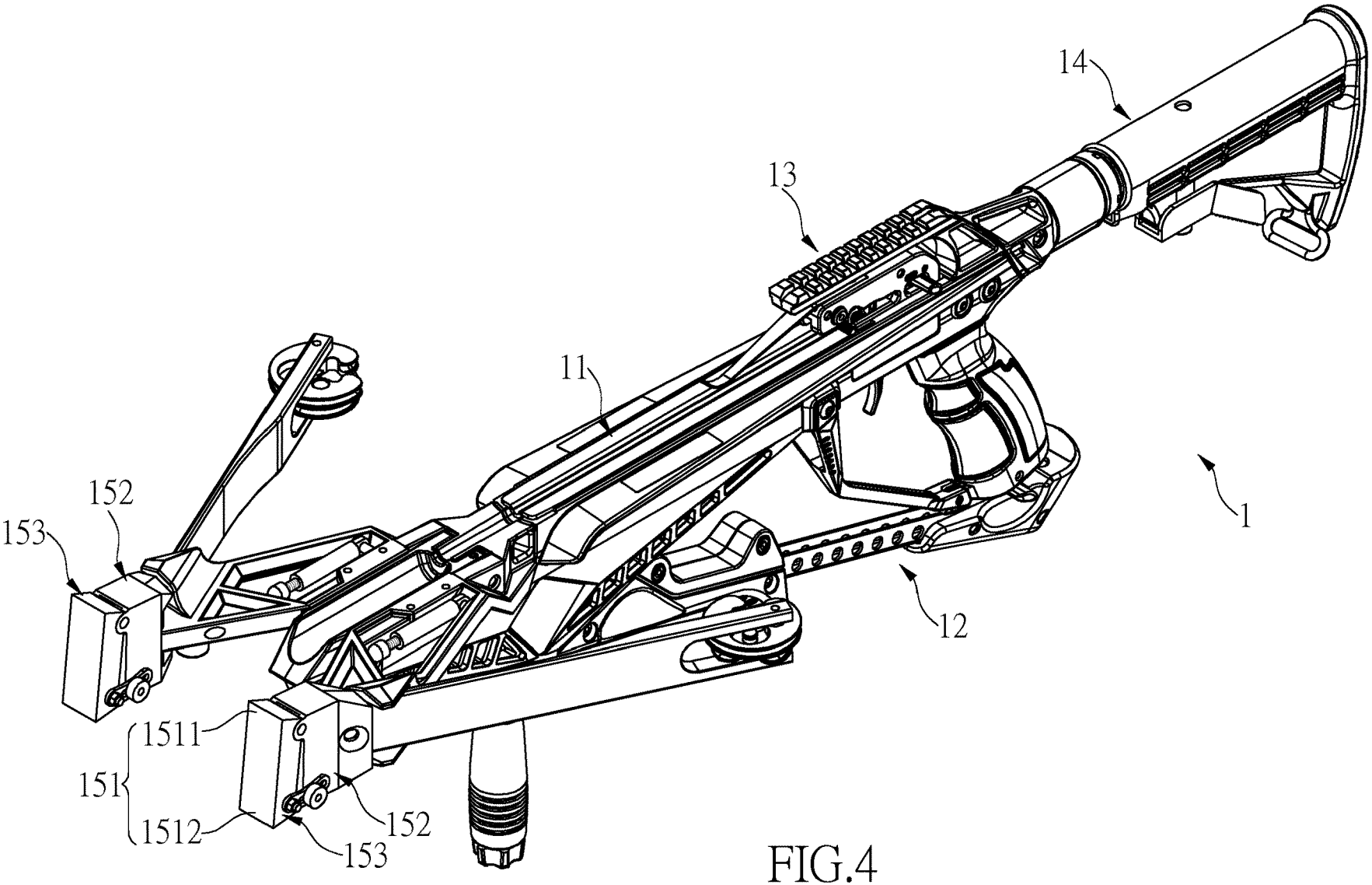
FIG. 4 is a perspective view to show the second embodiment of the crossbow with the support device of the present invention.
Figure 5:
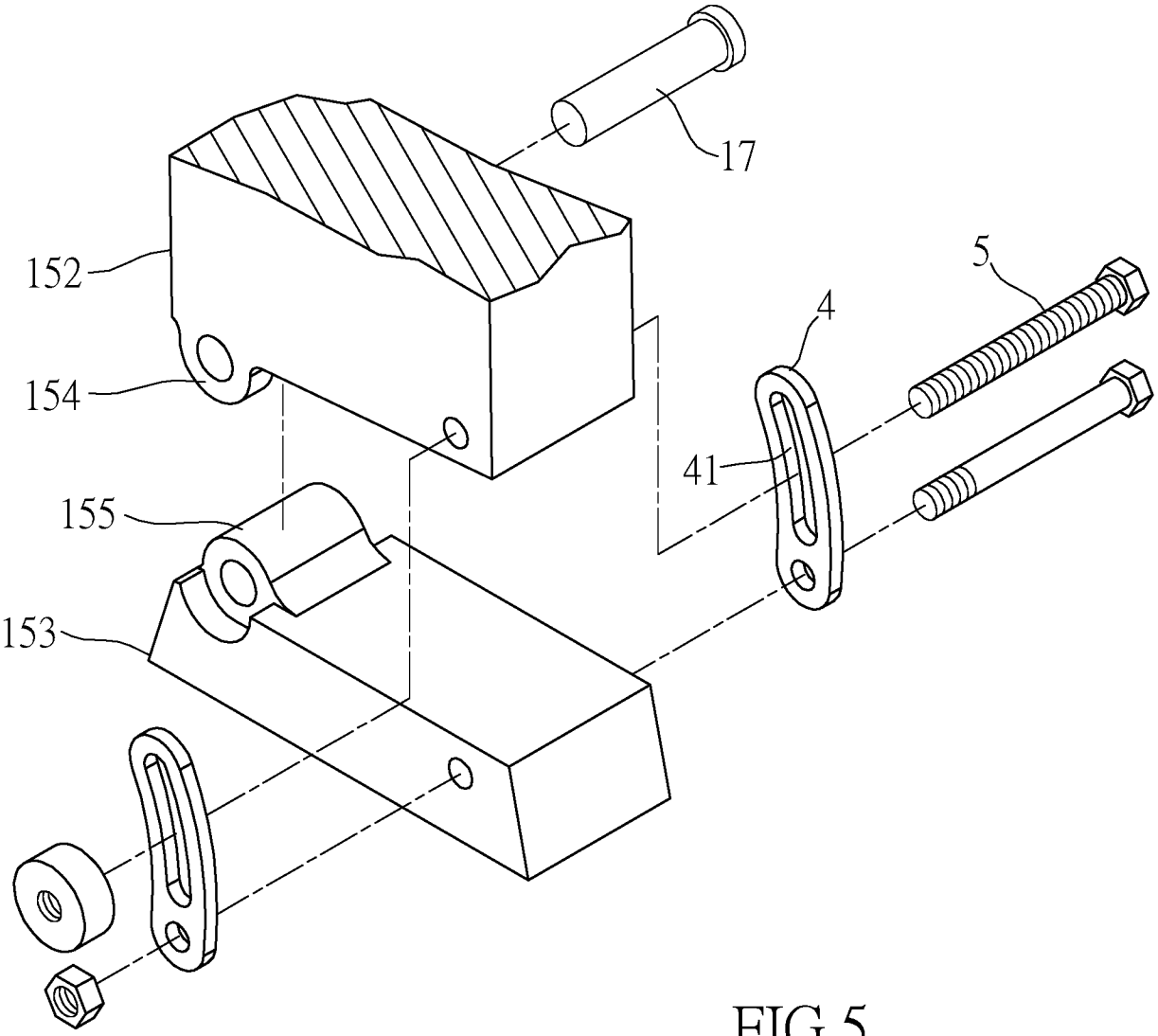
FIG. 5 is an exploded view of the support device of the second embodiment of the crossbow with the support device of the present invention.
Figure 6:
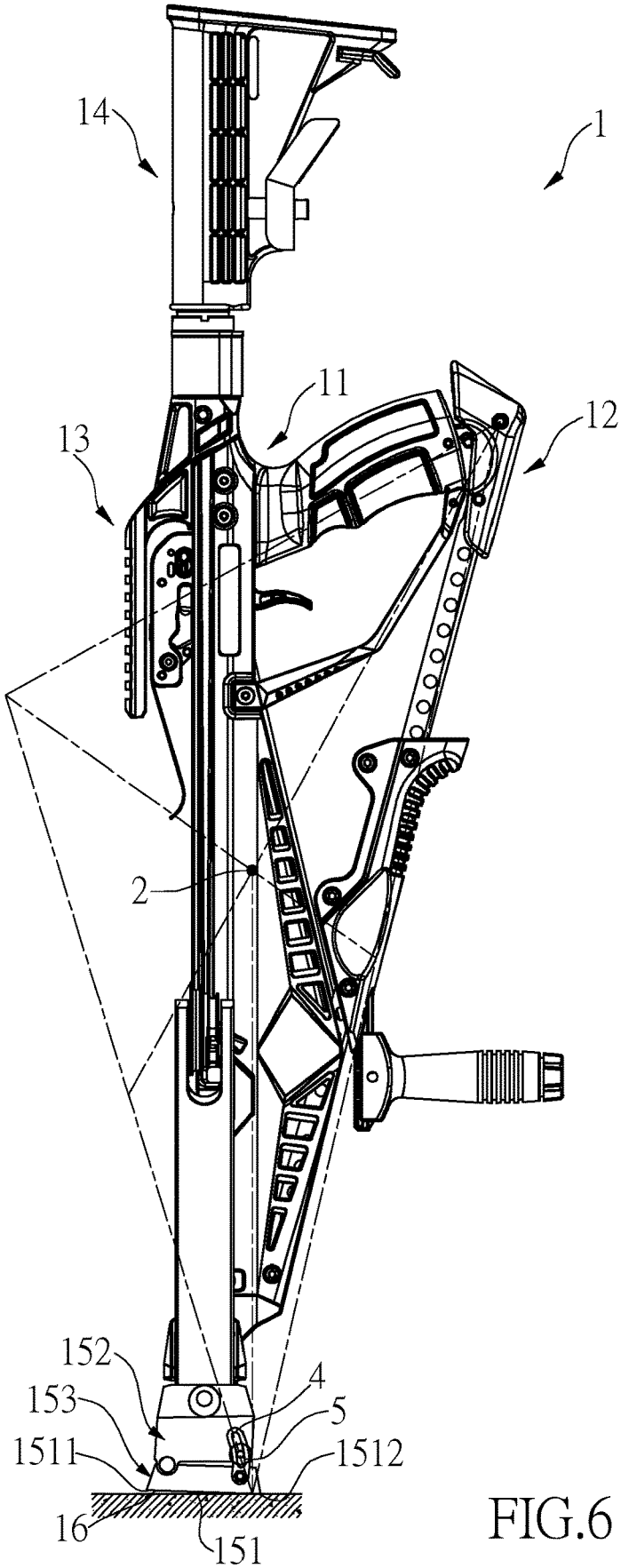
FIG. 6 shows that the second embodiment of the body of the crossbow is positioned at the first position.
Figure 7:
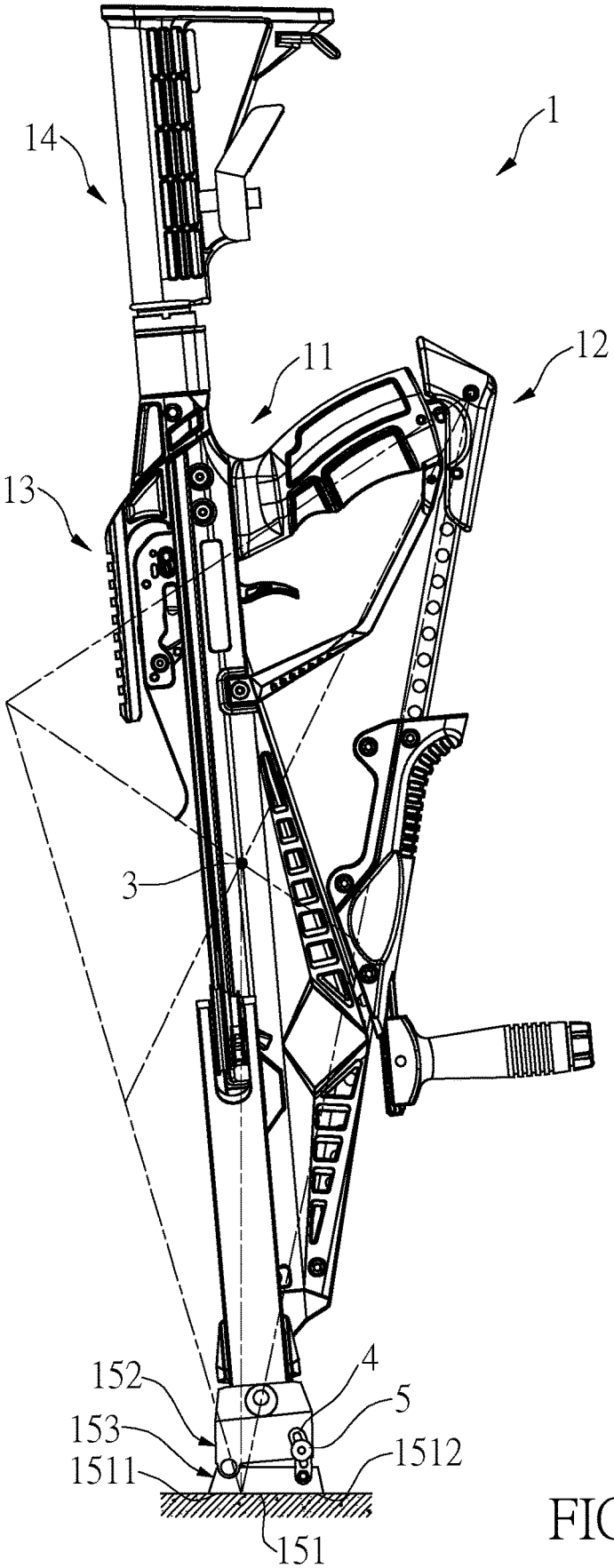
FIG. 7 shows that the second embodiment of the body of the crossbow is positioned at the second position.

Referring to FIGS. 1 to 3, the crossbow 1 comprises a body 11, a grip portion 12 on the underside of the body 11, an aim device rack 13 on the top side of the body 11, and a stock 14 connected to the rear end of the body 11. Two support devices 15 are respectively connected to two sides of the front end of the body 11, and each support device 15 has an inclined face 151 which faces forward and located beyond the front end of the body 11. Each inclined face 151 includes a low end 1511 which is located corresponding to the aim device rack 13, and a high end 1512 which is located corresponding to the grip portion 12. When not in use or shooting, the crossbow 1 can be positioned between a first position and a second position. When the user takes a rest and waits for the next shooting, the crossbow 1 is positioned at the first position, the two respective high ends 1512 of the two inclined faces 151 contact the ground, and an angle 16 is formed between the inclined face 151 of each support device 15 and the ground as show in FIG. 2. Preferably, the angle 16 is from 10 to 45 degrees. The grip portion 12 is usually heavier than an aim device (not shown) on the aim device rack 13, so that the body 11 tends to fall toward the side of the body 11 with the grip portion 12. The first position defines a first weight center 2 of the crossbow 1. The user then positions the crossbow 1 at the second position as shown in FIG. 3. Both of the high end 1512 and the low end 1511 of each of the two inclined faces 151 contact the ground. That is to say, the inclined face 151 of each support device 15 contact the ground. The second position defines a second weight center 3 of the crossbow 1. Therefore, the body 1 will tilt toward the top side of the body 11, the first weight center 2 transfers to the second weight center 3 so that the grip portion 12 and the aim device rack 13 reach a weight balance, and the body 11 does not fall. Therefore, the crossbow 1 does not have to lie on the ground.

In order to allow the body 11 to be positioned on an uneven ground, the second embodiment of the present invention is disclosed in FIGS. 4 to 7, wherein each of the support devices 15 includes a first block 152 and a second block 153. The first block 152 has the first end thereof fixed to the body 11, and the second end of the first block 152 includes two lugs 154. The second block 153 includes a protrusion 155 which is pivotably connected between the two lugs 154 by a pin 17 so that the second block 153 is pivotable relative to the first block 152. Two plates 4 are located on two sides of each second block 153, and each plate 4 has a curved slot 41. One of two bolts 5 extends through the two plates 4 and the second block 153, and the other one of the two bolts 5 extend through the two curved slots 41 of the two plates 4 and the first block 152. The two bolts 5 are respectively connected to a nut. When tighten the two bolts 5 which force the two plates 4 to secure the first and second blocks 152, 153 so that the second block 153 is not pivotable relative to the first block 152. On the contrary, when the two bolts 5 are loosened, the two bolts 5 release the two plates 4 not to secure the first and second blocks 152, 153 so that the second block 153 is pivotable relative to the first block 152. Each second block 153 has the inclined face 151 defined in one side thereof which is located opposite to the first block 152. When in use, the second block 153 is pivotable relative to the first block 152 according the unevenness of the ground. Therefore, the body 11 can be positioned at the second position on an uneven ground.

Figure 8:
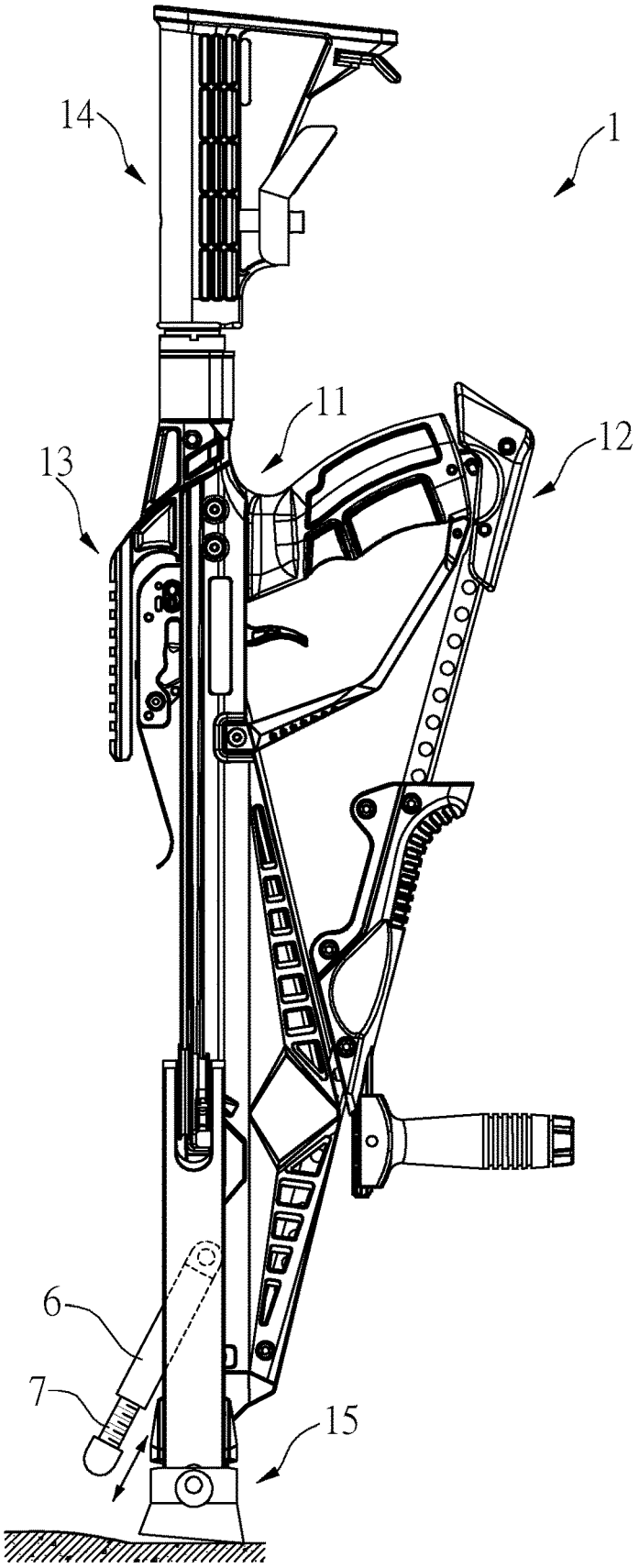
FIG. 8 shows that the assistance leg is to be used to support the crossbow.
Figure 9:
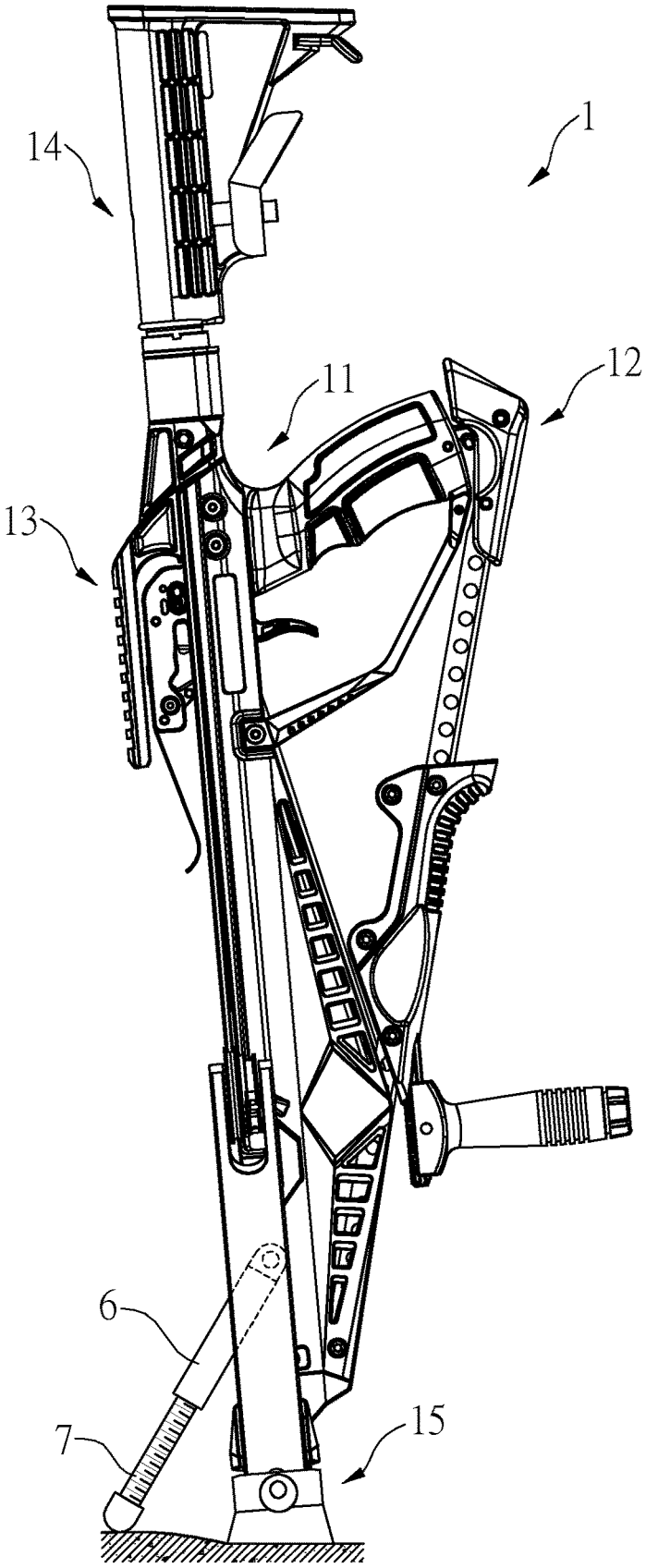
FIG. 9 shows that the assistance leg supports the crossbow which is positioned at the second position.

As shown in FIGS. 8 and 9, an assistance leg 6 is connected to each of the two sides of the body 11 and located close to the support device 15. The assistance leg 6 includes the first end thereof pivotably connected to the body 11, and the second end of the assistance leg 6 is threadedly connected to an extension portion 7. The assistance leg 6 is pivotable toward the low end 1511 of the inclined face 151. The extension portion 7 is adjustably and threadedly connected to the assistance 6 so as to contact the ground as shown in FIG. 9.

Figure 10:
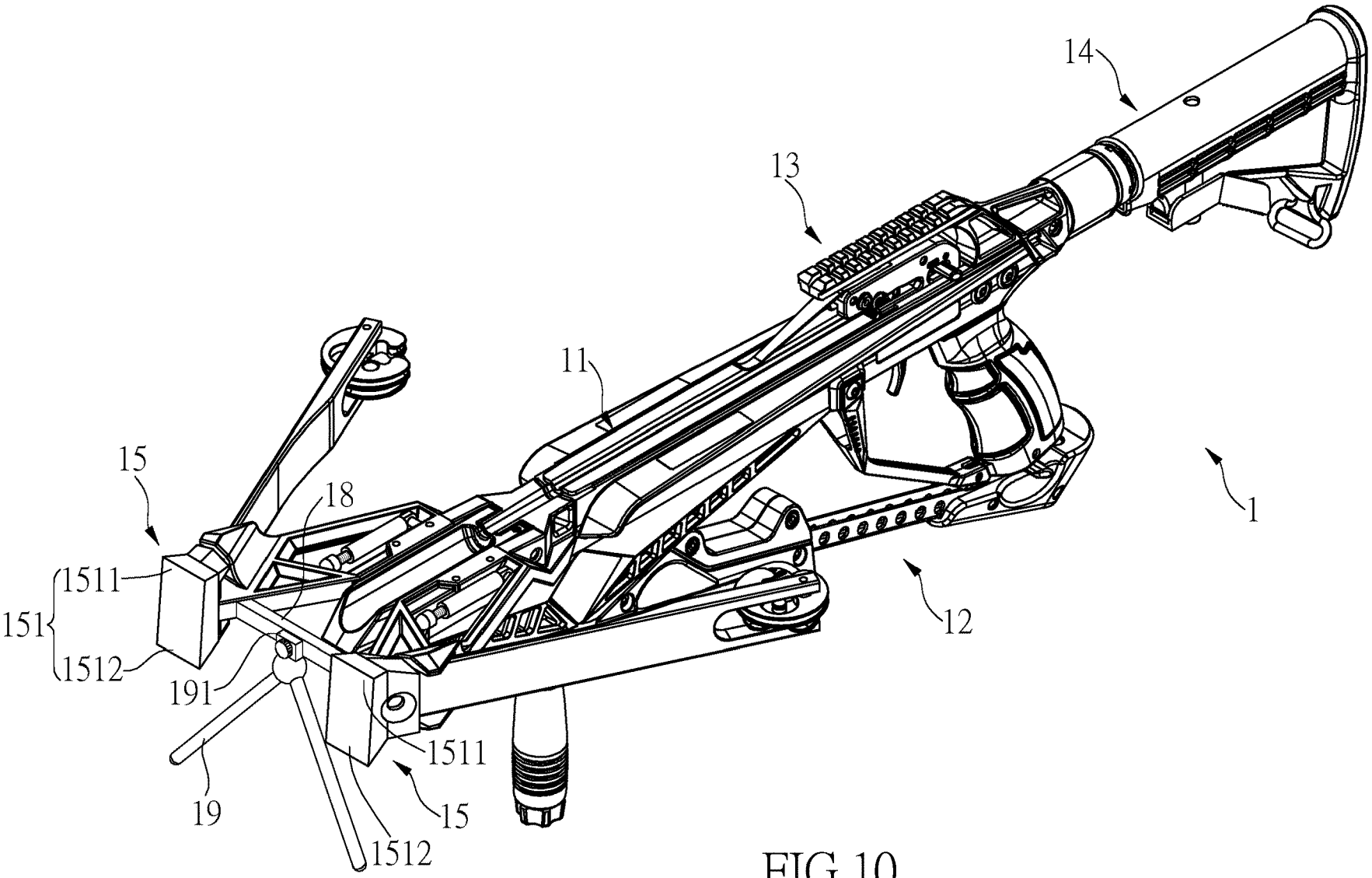
FIG. 10 shows the third embodiment of the crossbow with the support device of the present invention.
Figure 11:
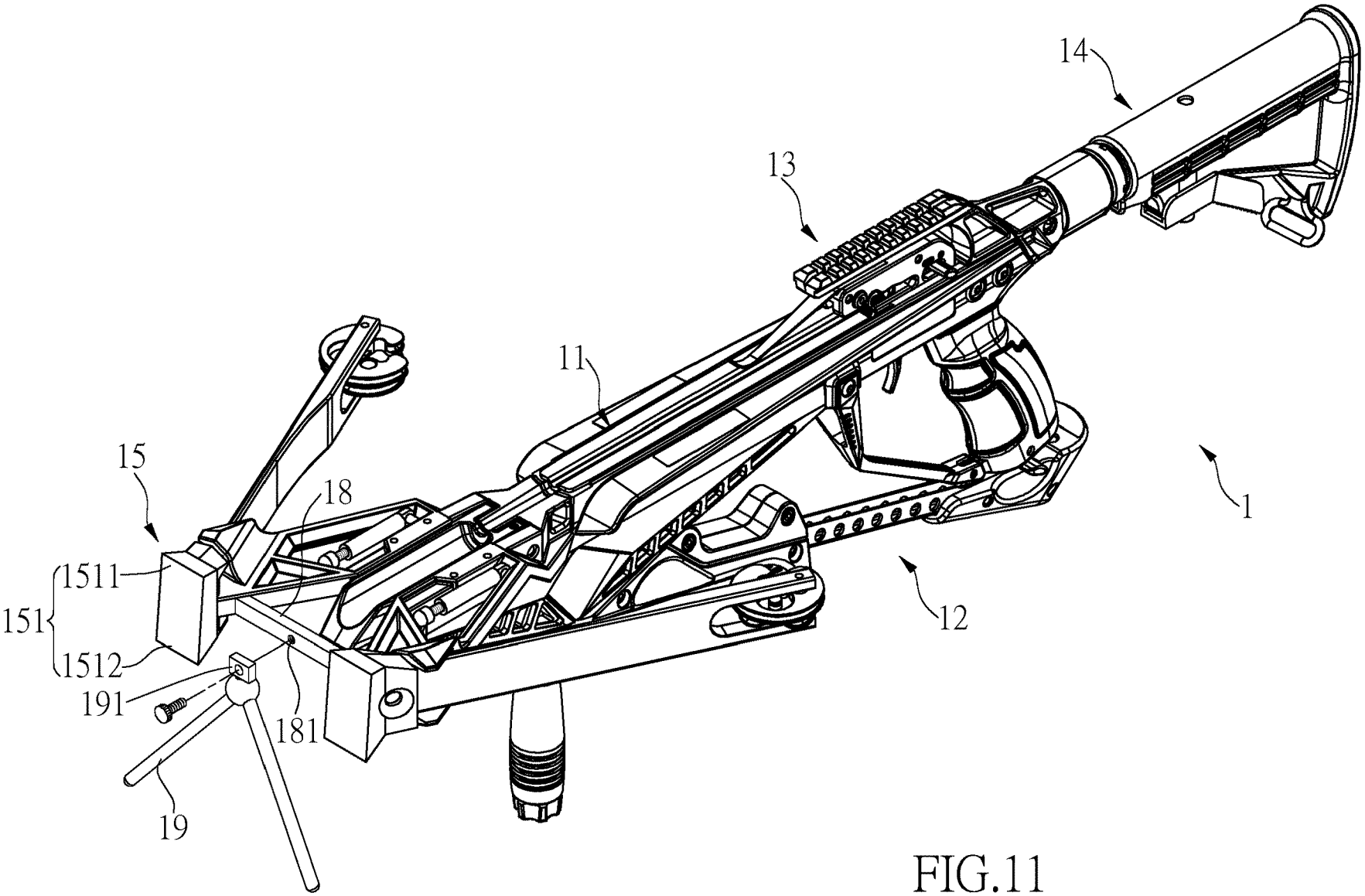
FIG. 11 shows that the third embodiment of the crossbow with the support device of the present invention has two support legs to be connected to the link.
Figure 12:
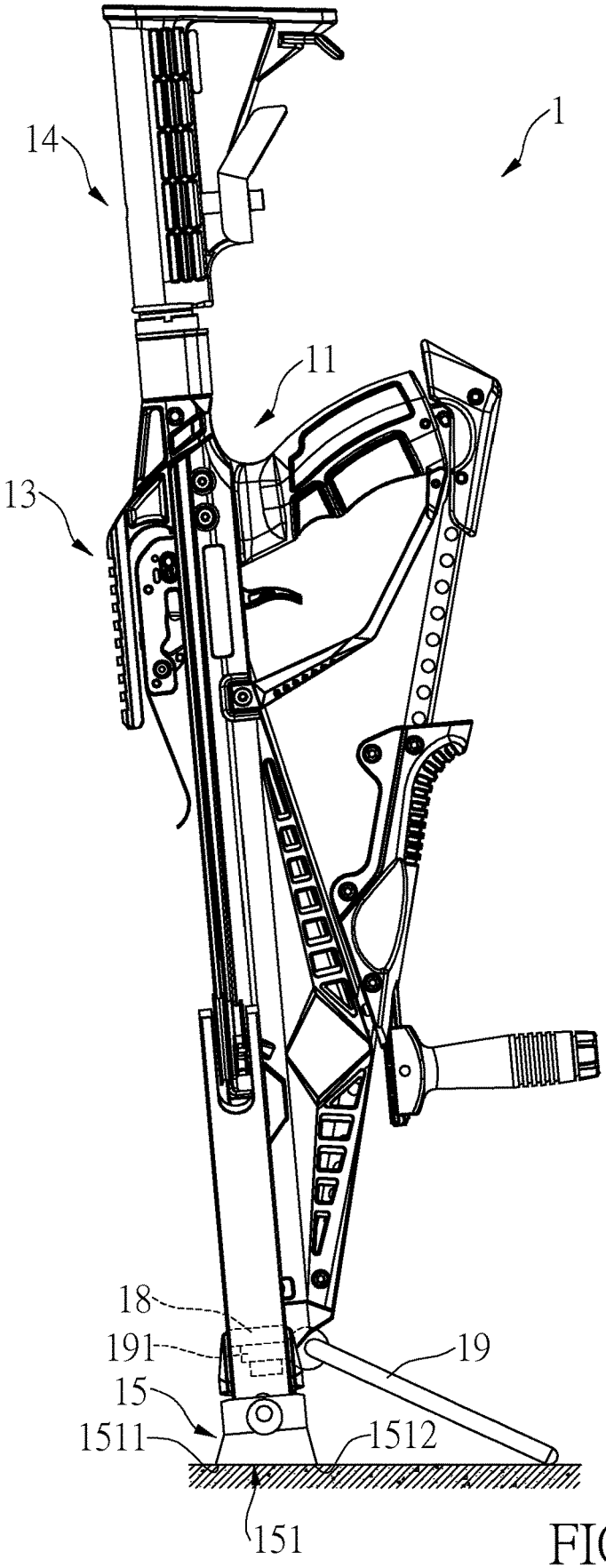
FIG. 12 shows that third embodiment of the crossbow with the support device of the present invention is positioned at the second position.

As shown in FIGS. 10 to 12, the crossbow can be installed with a tripod or the like. A link 18 is connected between the two support devices 15 and includes a lock hole 181 defined centrally therethrough. Two support legs 19 angularly extend from a base 191 which is locked to the lock hole 181 of the link 18. The two support legs 19 contact the ground to support the front end of the body 11 so that the user can operate the crossbow 1 in prone position.

While we have shown and described the embodiment in accordance with the present invention, it should be clear to those skilled in the art that further embodiments may be made without departing from the scope of the present invention.

What is claimed is:

1. A crossbow comprising:

a body, a grip portion on an underside of the body, an aim device rack on a top side of the body, a stock connected to a rear end of the body, two support devices respectively connected to two sides of a front end of the body, each support device having an inclined face which includes a low end which is located corresponding to the aim device rack, and a high end which is located corresponding to the grip portion;

a link connected between the two support devices and including a lock hole defined centrally therethrough, two support legs angularly extend from a base which is locked to the lock hole of the link, and the crossbow being positioned between a first position and a second position, the two respective high ends of the two inclined faces contacting the ground when the crossbow is positioned at the first position, an angle being formed between the inclined face of each support device and the ground, the first position defining a first weight center of the crossbow, when the crossbow is positioned at the second position, both of the high end and the low end of each of the two inclined faces contact the ground, the second position defining a second weight center of the crossbow, when the body shifts from the first position to the second position, the first weight center transfers to the second weight center so that the grip portion and the aim device rack reach a weight balance.

2. The support device for a crossbow as claimed in claim 1, wherein the angle is from 10 to 45 degrees.

* * * * *